United States Patent [19]

Werner

[11] Patent Number: 4,499,618

[45] Date of Patent: Feb. 19, 1985

[54] ADJUSTABLE BED WITH SINGLE CRANK AND PUSH-BUTTON CONTROL ASSEMBLY

[76] Inventor: Lester W. Werner, 4768 Tonga Dr., St. Louis, Mo. 63128

[21] Appl. No.: 211,540

[22] Filed: Dec. 1, 1980

[51] Int. Cl.[3] ..... A61G 7/10

[52] U.S. Cl. ..... 5/68; 5/66; 192/48.8

[58] Field of Search ..... 5/60, 66–69; 192/48.8; 74/471, 527

[56] References Cited

U.S. PATENT DOCUMENTS

| | | | |
|---|---|---|---|
| Re. 27,966 | 4/1974 | Burst | 5/67 |
| 1,704,754 | 3/1929 | Marvin | 74/471 X |
| 2,192,621 | 3/1940 | Radtke | 74/527 X |
| 2,980,140 | 4/1961 | McMillan | 74/471 X |
| 3,278,952 | 10/1966 | Holm | 5/68 |
| 3,465,373 | 9/1969 | Wilson | 5/68 X |
| 4,110,856 | 9/1978 | Benoit et al. | 5/66 X |

*Primary Examiner*—Alexander Grosz
*Assistant Examiner*—Michael F. Trettel

[57] ABSTRACT

A control assembly for an adjustable bed includes push-button devices for selectively engaging associated clutches. A single device may be actuated to engage a single clutch. Alternatively, a plurality of devices may be actuated simultaneously to engage a plurality of clutches. As any one or more buttons is pushed, a slide bar sequentially releases all devices and latches those for which buttons are pushed to the clutch-actuating position. A single crank provides torque for a transmission thereby clutched to lift screws.

10 Claims, 5 Drawing Figures

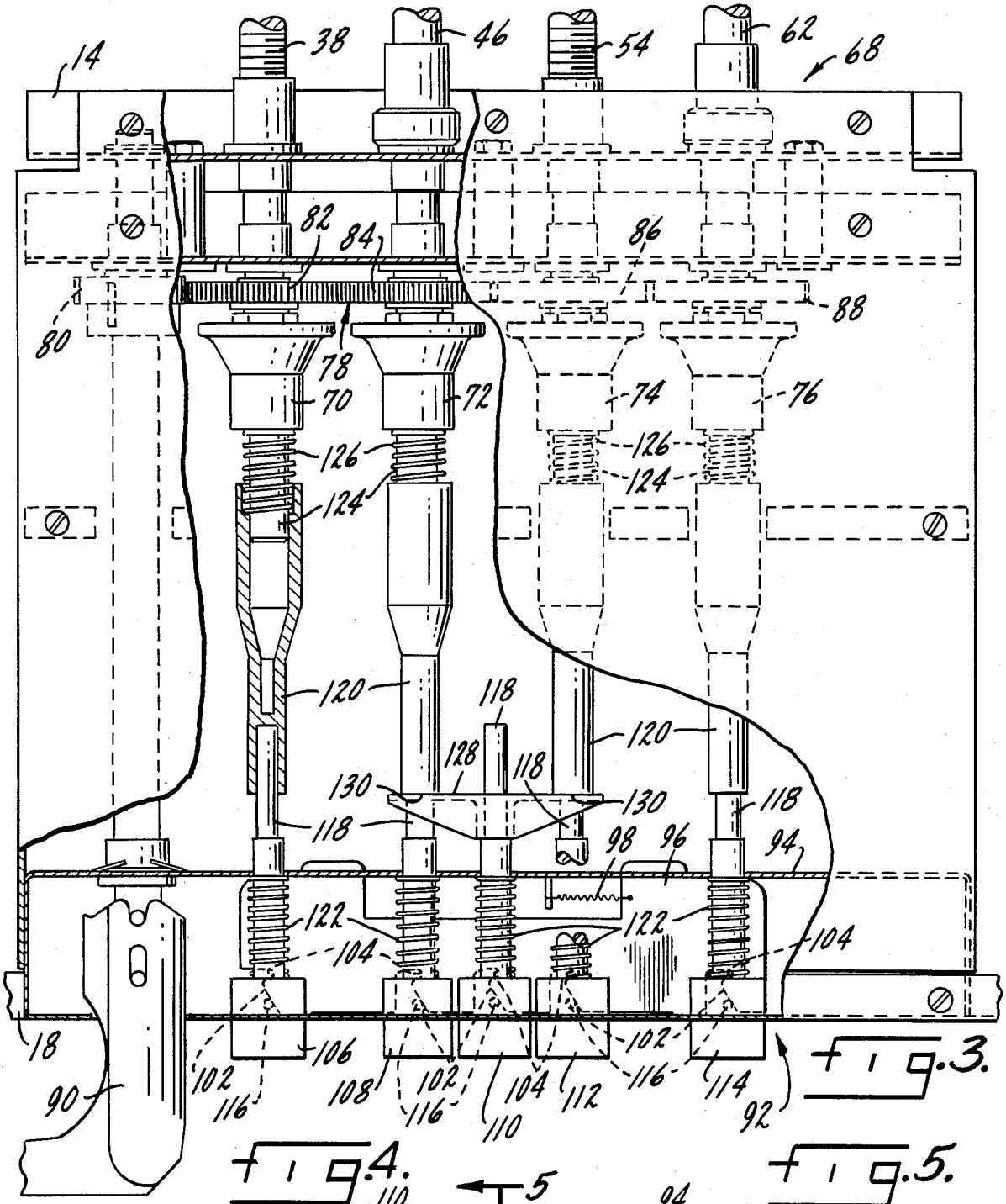
fig.3.
fig.4.
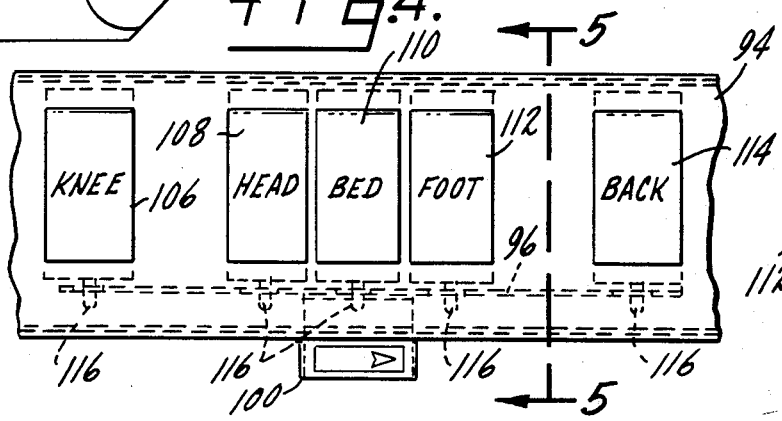
fig.5.
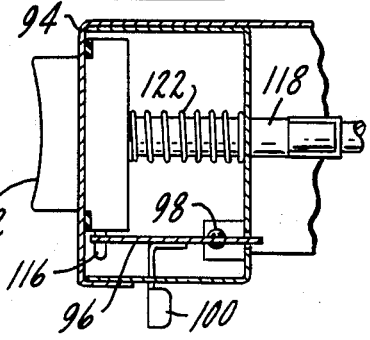

ADJUSTABLE BED WITH SINGLE CRANK AND PUSH-BUTTON CONTROL ASSEMBLY

BACKGROUND OF THE INVENTION

This invention relates generally to controlling the movement of adjustable beds. More particularly, it relates to an improved assembly for adjusting the various positions of a hospital bed.

In a hospital environment, it is necessary for a bed to be provided with multiple functional capabilities. It must be capable of vertical movement so that it may be raised or lowered to a desired position. It must be capable of tilting so that it may be placed in either the Trendelenburg position or the reverse Trendelenburg position. Further, the head and knee sections of the mattress support structure must be capable of individual adjustment to provide for patient comfort.

In the past, a typical assembly for controlling the various movements of a hospital bed required the selection of one function at a time. If it were desired, for example, to lower the back and knee sections, as well as move the bed into Trendelenburg, an attendant would first engage the back section and crank it to the desired position, then engage the knee section and crank it to the desired position, and finally engage the head section and crank it so as to tilt the movable frame.

There remains a need in the art to provide a simple, inexpensive, efficient, long-wearing assembly for controlling the various movements of a hospital bed, which assembly allows the selection of any one or combination of the various functional modes. The assembly should engage each function selected, and should be capable of actuating all of them simultaneously upon the rotation of a single crank. Since all functional movements do not require the same amount of cranking, the assembly should be capable of disengaging automatically whichever functions reach their limit of travel, while at the same time subjecting the remaining functions to further cranking action.

The assembly should preferably be located at or adjacent the control station at the foot of the bed so as to be easily operable by an attendant.

SUMMARY OF THE INVENTION

The primary object of this invention is to meet the needs noted above. To that end, there is provided an assembly which includes push-button devices for engaging the clutches of a transmission to thereby select one or more of the various functional modes necessary for hospital bed. After selection, a single crank drives lift screws and slip nuts, which in turn drive link mechanisms so as to move the various sections of the bed to their desired positions. A slide bar latches the push-button devices in order to hold associated clutches in their engaged positions. Pushing any button or combination of buttons releases whichever ones may previously have been pushed.

The result is a simple, inexpensive, efficient long-wearing assembly which provides the capability of selecting one or a combination of functional modes for the adjustment of a hospital bed and for simultaneous actuation of all modes selected.

BRIEF DESCRIPTION OF THE DRAWINGS

The objects and advantages of this invention will become apparent to those skilled in the art upon careful consideration of the specification herein, including the drawings, wherein:

FIG. 3 is a plan view, partially in section, showing the control assembly and additional details of the transmission;

FIG. 4 is an elevational view showing details of the push-button devices; and FIG. 5 is a sectional view taken along the line 5—5 of FIG. 4 showing additional details of the push-button devices.

Figure 1:
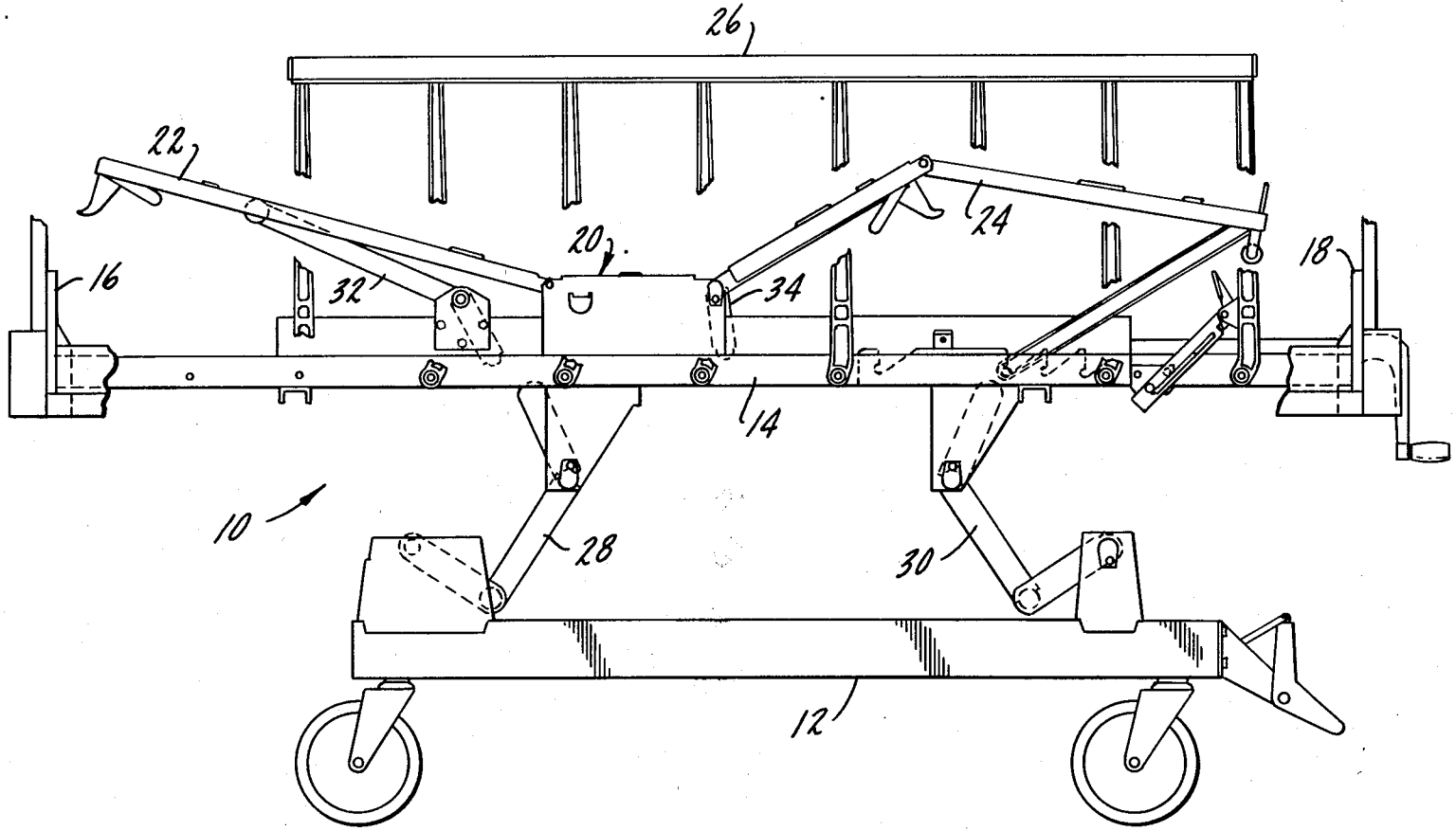
FIG. 1 is an elevational view of an adjustable hospital bed showing the arrangement of the various lift mechanisms.
Figure 2:
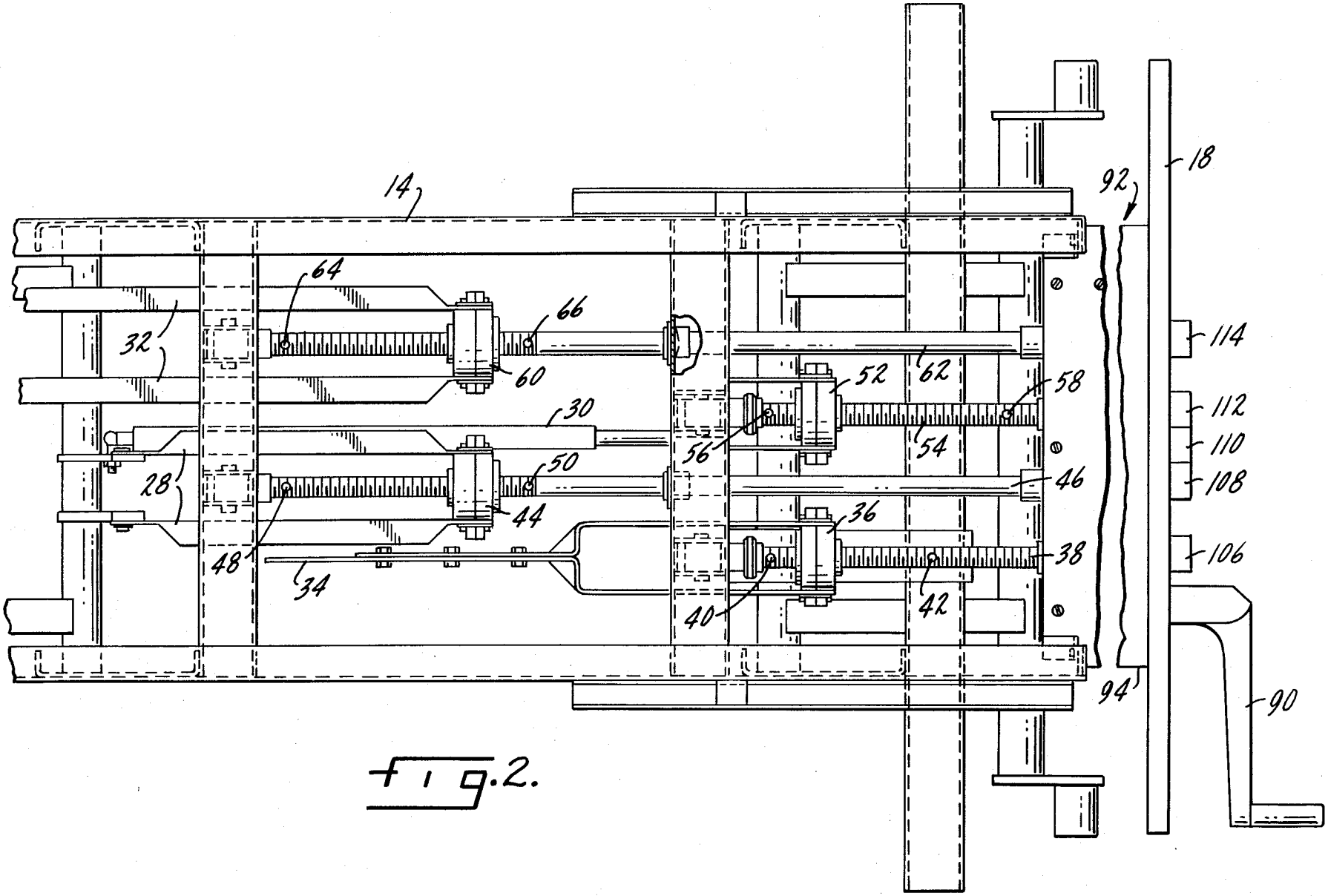
FIG. 2 is a partial plan view of the upper frame of the bed, cut away to show details of the lift mechanisms and transmission.

While this invention is susceptible of embodiment in many different forms, there is shown in the drawings and herein will be described in detail a preferred embodiment. It should be understood that the present disclosure is considered to be an exemplification of the principles of the invention, and is not intended to limit the invention to this embodiment.

DESCRIPTION OF A PREFERRED EMBODIMENT

Referring now to the drawings in greater detail, There is shown generally a typical hospital bed 10. Bed 10 includes a relatively fixed lower frame 12 and a movable upper frame 14 having a head end 16 and a foot end 18. Bed 10 also includes an articulated mattress support structure 20 having a back section 22 and a knee section 24. Suitable guard rails 26 are provided at the sides of bed 10.

A head lift mechanism 28 is provided for raising and lowering head end 16 of upper frame 14. Similarly, a foot lift mechanism 30 is provided for raising and lowering foot end 18 of upper frame 14. A back lift mechanism 32 and a knee lift mechanism 34 are provided for raising and lowering back section 22 and knee section 24 of structure 20, respectively.

Knee lift mechanism 34 is driven by a slip nut 36 threaded on a lift screw 38 for axial movement between limit stops 40 and 42. Head lift mechanism 28 is driven by a slip nut 44 threaded on a lift screw 46 for axial movement between limit stops 48 and 50. Foot lift mechanism 30 is driven by a slip nut 52 threaded on a lift screw 54 for axial movement between limit stops 56 and 58. Similarly, back lift mechanism 32 is driven by a slip nut 60 threaded on a lift screw 62 for axial movement between limit stops 64 and 66. The slip nuts, lift screws and limit stops form part of a transmission 68, details of which are disclosed in co-pending U.S. application Ser. No. 211,541 12/1/80, Lester W. Werner entitled Brake Mechanism for an adjustable Hospital bed. (Now aband.) provided for selectively rotating lift screws 38, 46, 54 and 62 so as to drive slip nuts 36, 44, 52 and 60, as desired.

Transmission 68 also includes a plurality of clutches 70, 72, 74 and 76, each engaged with an associated lift screw 38, 46, 54 and 62. Details of these clutches are disclosed in co-pending U.S. application Ser. No. 211,541, filed 12/1/80.

Transmission 68 further includes a gear train 78 having a drive gear 80 and driven gears 82, 84, 86 and 88. A single crank 90 is engaged with gear 80 for providing the torque to drive gear train 78. Selective engagement of clutches 70, 72, 74 and 76 respectively locks lift screws 38, 46, 54 and 62 to gears 82, 84, 86 and 88. It will be apparent that selective engagement of one or more clutches will result in one or more lift screws being rotated by crank 90, as desired.

Selective engagement of the clutches is provided by a control assembly 92. Assembly 92 includes a housing 94 secured to upper frame 14. A slide bar or plate 96 is supported by housing 94 for horizontal sliding movement as shown in FIG. 3. A spring 98 biases slide bar 96 to the left. A cancel lever 100 is provided to allow manual movement of slide bar 96 to the right against the biasing force of spring 98. Slide bar 96 defines a plurality of spaced cam or ramp surfaces 102. Associated with these cam surfaces are a plurality of detent slots 104.

Assembly 92 also includes a knee push-button device 106, a head push-button device 108, a bed push-button device 110, a foot push-button device 112 and a back push-button device 114. Each device includes a pin 116 and a rod 118. A tubular member 120 is slidably received on each rod 118 except the one associated with bed device 110. A spring 122 biases each device outwardly, or downwardly as shown in FIG. 3.

A shaft 124 extends through each clutch in telescoping relationship with an associated member 120. A load spring 126 is coiled around each shaft 124 between each clutch and member 120.

An arm 128 is secured to the rod 118 associated with bed device 110. This arm extends into contact with surfaces 130 defined by the rods 120 associated with head device 108 and foot device 112.

As shown in FIG. 3, the devices are in their first, disengaged position. Spring 98 biases slide bar 96 leftwardly such that pins 116 are substantially in contact with cam surfaces 102. In this position, none of clutches 70, 72, 74 or 76 is engaged. Rotation of crank 90 drives gear train 78, but does not drive any of lift screws 38, 46, 54 or 62.

If it is desired to raise or lower knee section 24 of mattress support structure 20, for example, knee button 106 is pushed inwardly, or upwardly as shown in FIG. 3. Its pin 116 rides up surface 102, thereby camming slide bar 96 to the right. At the same time, its rod 118 and member 120 compress load spring 126, thereby engaging knee clutch 70. When pin 116 reaches the top of surface 102, spring 98 pulls slide bar 96 leftwardly such that pin 116 is latched in detent slot 104. Thus, clutch 70 remains engaged. Rotation of crank 90 now turns knee lift screw 38.

It should be apparent that any number of buttons may be pushed simultaneously to selectively engage the associated clutches, whereupon rotation of crank 90 will turn the associated lift screws simultaneously. As disclosed in the aforementioned U.S. application Ser. No. 211,541 filed 12/1/80, when an associated slip nut reaches the limit of its travel, it slips while the remaining ones continue their travel.

For convenience, bed device 110 is provided for simultaneous engagement of head clutch 72 and foot clutch 74. By pushing bed button 110, arm 128 is moved so as to drive the two associated members 120, thereby compressing both of the associated load springs 126 to engage clutches 72 and 74. In this manner, head and foot lift screws 46 and 54 may be actuated simultaneously to raise or lower upper frame 14 without tilting it.

As noted, pushing any one or combination of the buttons shifts slide bar 96 to the right, at which time the remaining buttons are released from their associated detent slots to thereby unlatch the associated devices. Cancel lever 100 is provided to allow an attendant to shift slide bar 96 against the biasing force of spring 98 to release all of the buttons, if desired.

It should be apparent to those skilled in the art that there is disclosed herein an improved control assembly for selection of the various functional modes of an adjustable bed. The assembly is so constructed and arranged that either one or a plurality of functional modes may be selected. A single crank drives the appropriate lift screws, depending upon which functional mode or modes have been selected. The control assembly and cranking structure are simple, inexpensive, efficient and long-wearing and may be serviced easily in the field.

In a preferred form of the invention, the control assembly is provided with a plurality of push-button devices for selection of the various functional modes. It should be obvious however, that devices with other than push buttons may be provided for effecting such selection. Further, although a single crank is provided in the preferred form of the invention for driving the selected lift screws, obviously other suitable drive means may be provided.

It is not intend that the present invention be restricted in its application to the hospital bed shown herein by way of example. It is contemplated that the invention will be utilized in a wide variety of applications in which it is desirable to control the various modes of a frame having a plurality of functional capabilities.

It should be understood that while a preferred embodiment of the invention has been shown and described, this is to be considered as illustrative and may be modified by those skilled in the art. It is intended that the claims herein cover all such modifications as may fall within the spirit and scope of the invention.

What is claimed is:

1. An adjustable bed including a relatively fixed frame, a movable frame, a mattress support structure, head and foot lift mechanisms for raising and lowering the head and foot ends respectively of said movable frame, back and knee lift mechanisms for raising and lowering the back and knee sections respectively of said mattress support structure, transmission means engageable for directing torque to said lift mechanisms for actuation thereof, said transmission means including head, foot, back and knee lift screws respectively in driving relationship with said lift mechanisms, a gear train including a drive gear, and head, foot, back and knee driven gears in meshing relationship with said drive gear, head, foot, back and knee clutches selectively engageable for respectively establishing engagement of said driven gears with said lift screws, a manual crank engaged with said drive gear for rotation of said drive train, means associated with each of the lift mechanisms and its transmission means for stopping movement of the said lift mechanism when the limits of its travel are reached while permitting continued movement of another lift mechanism, manual control means for selectively engaging said transmission means with any number of said lift mechanisms for individual or simultaneous actuation thereof, and means for locking said control means in engaged position.

2. Apparatus comprising a housing, a plate slidable in said housing between first and second positions, first biasing means biasing said plate towards its first position, independent means for sliding said plate to its second position in opposition to said biasing means, said plate defining a plurality of cam surfaces and slots, a plurality of selecting devices each associated with a cam surface and slot, each device being movable between a first position and a second position latched in an associated slot, and second biasing means biasing each device toward its first position, said plate and devices being constructed and arranged such that as any number of devices are moved to their second position said plate is cammed to its second position thereby unlatching all devices, said plate then being biased to its first position thereby latching those devices in their second position.

3. The invention of claim 2, further comprising a plurality of lift screws, a gear train adapted for transmitting torque to said lift screws, and a plurality of clutches each engageable for clutching an associated lift screw to said gear train, each clutch being related to an associated device such that movement of said device to its first position releases said clutch for disengagement and movement of said device to its second position engages said clutch.

4. The invention of claim 3, one of said devices being related to two of said clutches such that movement of said one device to its first position releases said two clutches for disengagement and movement of said one device to its second position engages said two clutches.

5. The invention of claim 2, 3 or 4, each device being manually movable by a push button to its second position.

6. An adjustable bed comprising:

(a) a relatively fixed frame, (b) a movable frame, (c) a mattress support structure, (d) head and foot lift mechanisms for raising and lowering the head and foot ends respectively of said movable frame, (e) back and knee lift mechanisms for raising and lowering the back and knee sections respectively of said mattress support structure, (f) transmission means comprising head, foot, back and knee lift screws respectively in driving relationship with said lift mechanisms, a gear train including aa drive gear, and head, foot, back and knee driven gears in meshing relationship with said drive gear, head, foot, back and knee clutches selectively engageable for respectively establishing engagement of said driven gears with said lift screws, a crank engaged with said drive gear, and (g) control means for selectively engaging said transmission means with any number of said lift mechanisms for simultaneous actuation thereof, said control means comprising manually actuated head, foot, back and knee selecting devices for selectively effecting engagement of any number of said clutches, actuation of any of said devices sequentially effecting release of all clutches and engagement of those clutches associated with the devices actuated, a slide bar movable between first and second positions, means biasing said slide bar toward its first position, said slide bar defining a plurality of cam surfaces and detent slots, each device including a push button, a pin, a rod, and a member coupling said rod with an associated clutch, each device being movable from a first position in which said pin is contiguous to an associated cam surface and an associated clutch is released to a second position in which said pin is latched in an associated detent slot and said associated clutch is engaged, and means biasing each device toward its first position, said slide bar and device being constructed and arranged such that as said push button moves toward its second position said pin cams said slide bar toward its second position and said member engages said associated clutch.

7. An adjustable bed comprising:

(a) a relatively fixed frame, (b) a movable frame, (c) a mattress support structure, (d) head and foot lift mechanisms for raising and lowering the head and foot ends respectively of said movable frame, (e) back and knee lift mechanisms for raising and lowering the back and knee sections respectively of said mattress support structure, (f) transmission means comprising head, foot, back and knee lift screws respectively in driving relationship with said lift mechanisms, a gear train including a drive gear, and head, foot, back and knee driven gears in meshing relationship with said drive gear, head, foot, back and knee clutches selectively engageable for respectively establishing engagement of said driven gears with said lift screws, and a crank engaged with said drive gear, and (g) control means for selectively engaging said transmission means with any number of said lift mechanisms for simultaneous activation thereof, said control means comprising manually actuated head, foot, back and knee selecting devices for selectively effecting engagement of any number of said clutches, a manually actuated bed selecting device for simultaneously effecting engagement of said head and foot clutches, actuation of any of said devices sequentially effects release of all clutches and engagement of those clutches associated with the devices actuated, a slide bar movable between first and second positions, means biasing said slide bar toward its first position, said slide bar defining a plurality of cam surfaces and detent slots, each device including a push button, a pin, a rod, and a member coupling said rod with an associated clutch, each device being movable from a first position in which said pin is continguous to an associated cam surface and an associated clutch is released to a second position in which said pin is latched in an associated detent slot and said associated clutch is engaged, and means biasing each device toward its first position, said slide bar and device being constructed and arranged such that as said push button moves toward its second position said pin cams said slide bar toward its second position and said member engages said associated clutch.

8. The invention of claim 7, said bed selecting device including an arm in driving relationship with the members of said head and foot selecting devices to thereby engage said head and foot clutches when the button of said bed selecting device is pushed.

9. An adjustable bed including a relatively fixed frame, a movable frame, a mattress support structure, head and foot lift mechanisms for raising and lowering the head and foot ends respectively of said movable frame, back and knee lift mechanisms for raising and lowering the back and knee sections respectively of said mattress support structure, transmission means engageable for directing torque to said lift mechanisms for actuation thereof, means associated with each of the lift mechanisms and its transmission means for stopping movement of the said lift mechanism when the limits of its travel are reached while permitting continued movement of another lift mechanism and control means for selectively engaging said transmission means with any number of said lift mechanisms for simultaneous action thereof, said control means including manually actuated head, foot, back and knee selecting devices constructed and arranged such that actuation of any of said devices sequentially effects disengagement of said transmission means with all lift mechanisms and locking engagement with those lift mechanisms associated with the devices actuated.

10. The invention of claim 9, said control means also including a manually actuated bed selecting device constructed and arranged such that actuation thereof sequentially effects disengagement of said transmission means with all lift mechanisms and locking engagement simultaneously with said head and foot lift mechanisms.

* * * * *